US006942325B2

(12) United States Patent
Nanjo

(10) Patent No.: US 6,942,325 B2
(45) Date of Patent: Sep. 13, 2005

(54) PACKAGING STRUCTURE FOR LIQUID CONTAINER AND UNSEALING METHOD THEREFOR

(75) Inventor: Tatsuo Nanjo, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 10/382,523

(22) Filed: Mar. 7, 2003

(65) Prior Publication Data

US 2003/0174192 A1 Sep. 18, 2003

(30) Foreign Application Priority Data

Mar. 18, 2002 (JP) ..... 2002-074263

(51) Int. Cl.[7] ..... B41J 2/175
(52) U.S. Cl. ..... 347/86; 53/410
(58) Field of Search ..... 347/85, 86, 87, 347/108; 206/320, 576, 701, 497, 523, 722, 206, 461, 466; 53/410, 139.5, 139.6, 139.7

(56) References Cited

U.S. PATENT DOCUMENTS

| | | | | |
|---|---|---|---|---|
| 5,231,416 A | | 7/1993 | Terasawa et al. | 347/23 |
| 5,701,995 A | | 12/1997 | Higuma et al. | 206/205 |
| 5,831,652 A | * | 11/1998 | Hinami et al. | 347/86 |
| 6,276,786 B1 | * | 8/2001 | Eida et al. | 347/86 |
| 6,286,946 B1 | | 9/2001 | Umemura et al. | 347/86 |
| 6,402,298 B1 | | 6/2002 | Nanjo et al. | 347/49 |
| 2001/0017640 A1 | | 8/2001 | Inada et al. | 347/84 |
| 2002/0109761 A1 | | 8/2002 | Shimizu et al. | 347/86 |
| 2002/0122103 A1 | | 9/2002 | Yamamoto et al. | 347/85 |
| 2002/0122104 A1 | | 9/2002 | Hatasa et al. | 347/86 |

FOREIGN PATENT DOCUMENTS

| | | |
|---|---|---|
| EP | 792749 | 9/1997 |
| JP | 6-328712 | 11/1994 |
| JP | 7-323565 | 12/1995 |

* cited by examiner

*Primary Examiner*—Anh T. N. Vo
(74) *Attorney, Agent, or Firm*—Fitzpatrick, Cella, Harper & Scinto

(57) ABSTRACT

A packaging structure of a liquid container, which is provided with a liquid containing portion for containing liquid and a liquid supply port for supplying liquid, comprises a covering member for covering the liquid supply port. For this packaging structure, the covering member is a circular member formed by a first part and a second part to cover the outer circumference of the liquid container, and the first part is provided with means for sealing the liquid supply port, and the second part is made detachable from the first part, and the circular form of the covering member is broken by the detachment of the second part. With the packaging structure thus arranged, when the user detaches the first part from the second part of the covering member, the covering member is broken to separate the first part and the second part, thus unsealing the liquid supply port. Therefore, unsealing is possible at a constant impetus irrespective of the impetus of unsealing carried out by each individual user. Also, the unsealing impetus can be controlled by the strength of material used for the first part to make the set up of the prevention of liquid splash possible at the time of unsealing.

18 Claims, 12 Drawing Sheets

PACKAGING STRUCTURE FOR LIQUID CONTAINER AND UNSEALING METHOD THEREFOR

BACKGROUND OF THE INVENTION

1. Field of the Invention

The present invention relates to a liquid container for containing recording liquid, such as ink, for example, which is detachably mountable on an ink jet recording apparatus. More particularly, the invention relates to the packaging structure of such liquid container.

2. Related Background Art

Conventionally, for example, there has been proposed the exchangeable ink tank for supplying ink to an ink jet recording head through an ink supply tube, which is structured separately from the ink jet recording head that records on a recording medium by discharging ink. The exchangeable ink tank is provided with an ink supply port for supply ink to the recording head, and an atmosphere communication port that enables the inside of the ink tank to be communicated with the air outside. In many cases, the structure is arranged so as to provide an ink absorbent for the inside of the housing thereof, and retain ink in the ink absorbent.

It is required for the aforesaid exchangeable ink tank to seal the ink supply port and atmosphere communication portion with a sealing member for the prevention of ink leakage at the time of product distribution. More specifically, there has been known the one having the structure in which a flexible sealing member is used to cover the atmosphere communication port and ink supply port, and the portions of the sealing member are adhesively bonded or thermally bonded to the circumferences of the atmosphere communication port and ink supply port, thus keeping the ink tank airtight. As the method for unsealing the ink supply port and atmosphere communication port, it is usually practiced that the user peels off the sealing member directly for the purpose. This packaging mode is inexpensive and makes it possible to keep the ink tank airtight reliably. Therefore, it is adopted for many ink tanks.

However, for the aforesaid conventional ink tank, there is such a case where the adhesive bonding or thermal bonding is given strongly to the sealing member provided for the ink supply port portion in consideration of the rise of inner pressure in the ink tank due to the environmental changes at the time of product distribution. In this case, the user should peel off the sealing member with an extra force, because the force needed to peel off the bonded portion of the sealing member (exfoliative force) is made higher.

In executing an unsealing method of the kind, the force used for peeling off the sealing member is opened so that the sealing member is removed form the ink tank vigorously. As a result, there is a fear that the ink, which has been airtightly kept by the sealing member, may splash to stain the user's hand or objects that surround the ink tank in some cases.

There are two mechanisms that may cause ink to splash at the time of unsealing the seal. The first is the ink splashes between the ink absorbent and the sealing member, and the second is the splashes of ink that adheres to the sealing member.

As shown in FIGS. 9A, 9B, and 9C, the first one acts in the direction in which the inner volume of an ink tank 51 expands when a sealing member is vigorously separated from the ink supply port. Also, by the inertia exerted by the separation of the sealing member 52, ink 54 existing between the ink absorbent 53 and the sealing member 52 is drawn to follow the sealing member 52. In this case, ink thus drawn is broken eventually at the last. Then, the ink droplets 54, which do not adhere to either side of the ink absorbent 53 or the sealing member 52, are separated and caused to splash out.

Also, as shown in FIGS. 10A, 10B, and 10C, the second one may take place in such a manner that immediately after the sealing member 52 is unsealed, the sealing member 52 is snapped to flutter instantaneously when the sealing member 52 bonded to the ink supply port 55 is separated from the ink supply port 55, and the ink droplets 54*a* adhering to the sealing surface splash in some cases.

In order to prevent ink from splashing at the time of unsealing the sealing, there is a structure as shown in FIGS. 11A and 11B, in which a cap 62 is welded to an ink supply port 61, thus keeping the ink tank 63 airtight. When this ink tank is unsealed, the cap is turned in the direction different from the one in which the cap 62 is detached so as to shear the welded portion 64. After that, the cap 62 is taken away. Therefore, when the cap is unsealed, the voluminal expansion does not occur inside the ink tank 63. Also, there is no vigorous unsealing, because the cap 62 is detached after the welding is opened. With unsealing means of the kind, a cap is turned to be unsealed, thus making it possible to prevent the ink splashing that tends to take place in the case where the sealing member shown in FIGS. 10A to 10C is used for opening means.

Also, for this cap, the structure is arranged so as not to provide any gap between the ink absorbent in the ink tank 63 and the cap 62 of the ink supply port 61. In this way, a devise is given to minimize the presence of free ink inside the cap before it is unsealed.

Nevertheless, there is an action to "twist" the cap for unsealing the aforesaid ink tank. This "twisting" action is such as to pinch the cap with fingers, and turn the wrist. Therefore, this action of turning the wrist or "twisting" is a difficult one for children, aged persons, or a user who has difficulty in using his hand or wrist. For that matter, it has been required to provide a simpler and more convenient mode of ink tank package.

SUMMARY OF THE INVENTION

The present invention is designed with a view to solving the problems discussed above. It is an object of the invention to provide a highly reliable packaging structure for a liquid container, which is capable of preventing ink splashes from the ink supply port when it is unsealed, and also, unsealed easily by anyone.

In order to achieve the aforesaid object, the packaging structure of a liquid container of the present invention for a liquid container, which is provided with a liquid containing portion for containing liquid and a liquid supply port for supplying liquid, comprises a covering member for covering the liquid supply port. For this packaging structure, the covering member is a circular member formed by a first part and a second part to cover the outer circumference of the liquid container, and the first part is provided with means for sealing the liquid supply port, and the second part is made detachable from the first part, and the circular form of the covering member is broken by the detachment of the second part.

With the packaging structure thus arranged, when the user detaches the first part from the second part of the covering member, which is formed to be circular to cover the outer circumference of the liquid container, the covering member is broken to separate the first part and the second part, thus unsealing the liquid supply port. With the structure of the kind, unsealing is not effectuated by directly removing means for sealing a liquid supply port, but by the detaching operation of the second part to unseal it indirectly. Therefore, irrespective of the impetus of unsealing carried out by each individual user, unsealing is possible at a constant impetus. Also, the unsealing impetus can be controlled by the strength of material used for the first part to make the set up of the prevention of liquid splash possible at the time of unsealing.

In a case of the packaging thus structured, it is preferable to adopt the material and shape of the first part so as to be maintained along the outer circumference of the liquid container even when the second part is detached from the first part. With the structure thus arranged, the first part remains on the outer circumference of the liquid container after the detachment of the second part. Therefore, the first part does not fall off from the liquid container by the detachment of the second part. Further, it may be possible to apply a weak bonding between the first part and the liquid container, which is just good enough to keep the first part not to fall off. Even with such structure, the first part does not fall off from the liquid container after the detachment of the second part as described above. In other words, in accordance with the aforesaid structure, the first part is not bonded to the liquid container with such strong bonding force as to keep air tightness as in the conventional example, but with weak bonding force. Therefore, the user is not required to exercise any vigorous pull when the first part is removed. Consequently, there occurs no splash of liquid adhering to the means for sealing the liquid supply port.

Also, the user's operation of unsealing the liquid supply port is only to break the covering member by detaching the second part, and just to remove the first part. Further, there is no regulation given to the impetus at the time of unsealing. Consequently, there is no need for exercising any large force, and anyone can carry-out unsealing operation simply.

In this respect, it is preferable to use a material in the form of film or more preferably a material in the form of thermally shrinkable film for the aforesaid covering member. Also, the covering member may be an elastic member.

Further, for the packaging structure described above, it is adoptable to form the first part and the second part integrally, and provide boundary breaking means for the boundary between the first part and the second part. In this case, it is conceivable to use perforations as such breaking means.

Or, for the aforesaid packaging structure, it may be adoptable to form the first part and the second part separately, and then, to detachably bond the second part to the first part.

Also, it may be adoptable to use a cap member as means for sealing the liquid supply port. In this case, it is preferable to form the cap member with an elastic member or elastomer.

Also, when the liquid container is provided with an atmosphere communication port for enabling the space in the container to be communicated with the air outside, it may be possible to provide further an elastic member to cover the atmosphere communication port. In this case, such elastic member that covers the atmosphere communication port is provided for the second part. Then, it is made possible to set up an unsealing order so that the ink supply port is open after the atmosphere communication port is open. In this way, it becomes possible to make the possibility smaller still that ink leaks at the time of unsealing the ink tank. Furthermore, even if the structure is such that the atmosphere communication port is bonded to the second part for sealing it, it is still possible to set up the unsealing order so that the ink supply port is open after the atmosphere communication is open, thus the fear of ink leakage as described above being made smaller still.

BRIEF DESCRIPTION OF THE DRAWINGS

FIG. 1A is a perspective view of the ink tank; and FIG. 1B is a side view of the ink tank.

FIG. 5A shows the state before the unsealing operation begins; FIG. 5B shows the state during the unsealing operation; FIG. 5C is a perspective view that shows the ink tank after unsealing; and FIG. 5D is a front view that shows the behavior of the ink tank in a first part after unsealing.

FIG. 13A is a side view of the ink tank after unsealing; and FIG. 13B is a front view of the ink tank after unsealing.

DETAILED DESCRIPTION OF THE PREFERRED EMBODIMENTS

Hereinafter, with reference to the accompanying drawings, the description will be made of the embodiments in accordance with the present invention.

(First Embodiment)

Figure 1A:
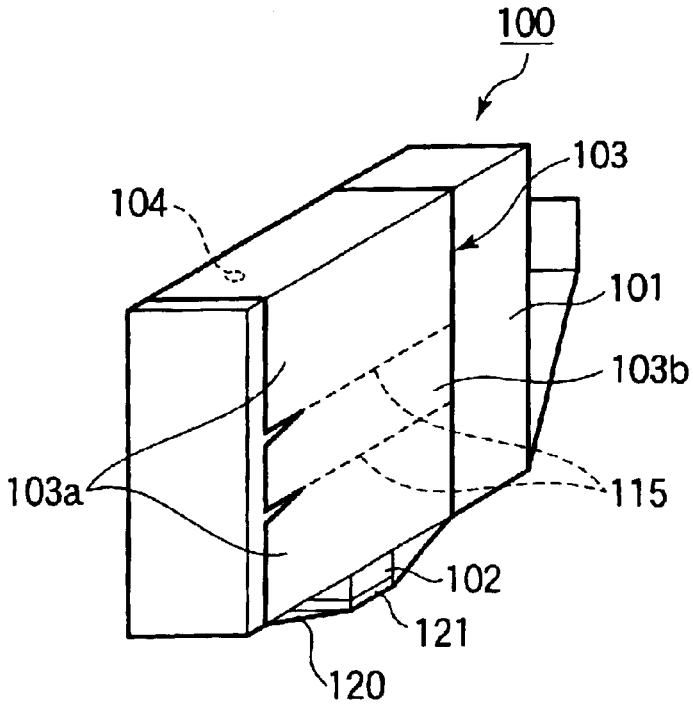
FIGS. 1A and 1B are views that illustrate the entire structure of an ink tank in accordance with a first embodiment of the present invention.
Figure 1B:
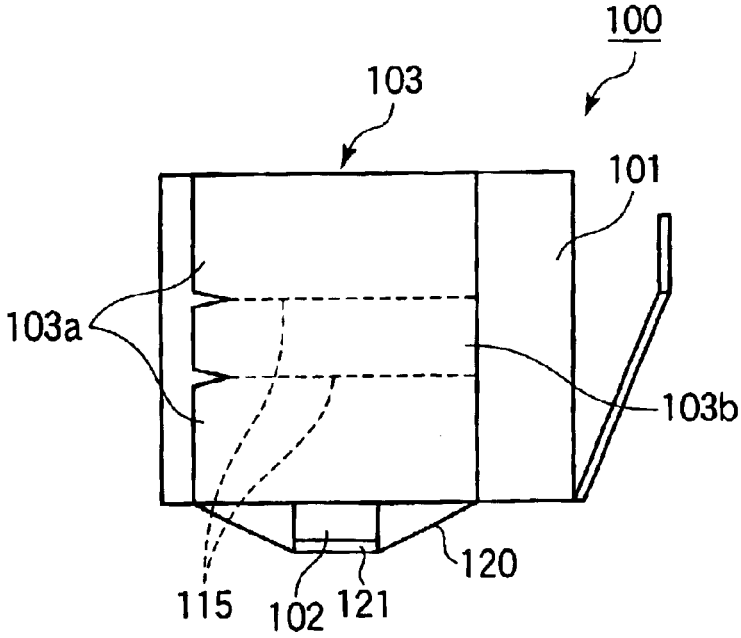

FIGS. 1A and 1B are views that illustrate the entire structure of an ink tank in accordance with a first embodiment of the present invention; FIG. 1A is a perspective view of the ink tank; and FIG. 1B is a side view of the ink tank.

An ink tank 100 shown in FIGS. 1A and 1B is provided with an ink container 101 that contains ink; an ink supply port 102 that supplies ink to the outside (for example, an ink jet recording head); an atmosphere communication port 104 that induces and exhausts the air; and a covering member 103 that covers the ink supply port 102, and also, covers the entire body of the ink container 101. The covering member 103 is structured with a first part 103*a* and a second part 103*b*. Further, the first part 103*a* is provided with the cap 121 that keeps the ink supply port 102 airtight, and a wrapping member 120 that wraps the ink container 101 including the cap 121.

Figure 2A:
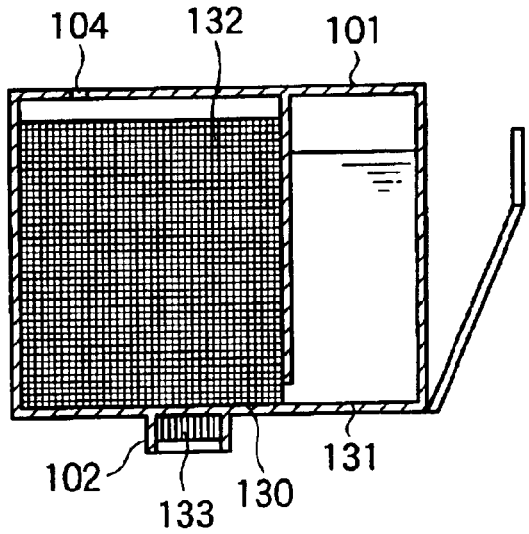
FIGS. 2A and 2B are cross-sectional views that illustrate the ink container represented in FIGS. 1A and 1B, taken along the plane in parallel to the surface of the largest area.
Figure 2B:
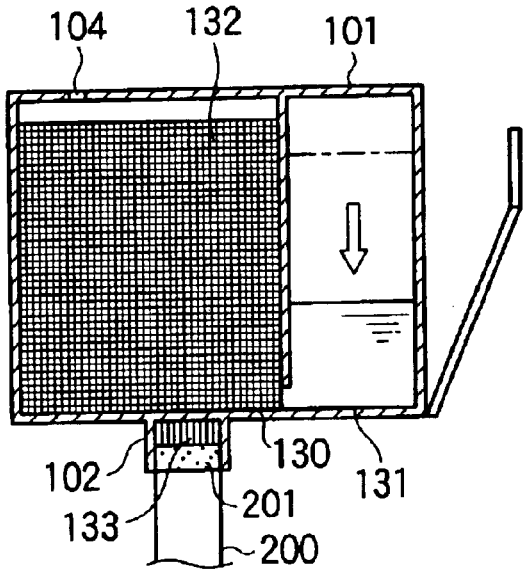

FIGS. 2A and 2B are cross-sectional views that show the ink container 101 represented in FIGS. 1A and 1B, taken along the plane in parallel to the surface of the largest area. As shown in FIGS. 2A and 2B, the ink container 101 is rectangular, the contour of which is flat. The inside of the ink container 101 (liquid containing portion) is formed by the negative pressure-generating member containing chamber 130 for housing the negative pressure-generating member 132 that absorbs and holds ink by generating negative pressure, and an ink-containing chamber 131 provided adjacent to the negative pressure-generating member containing chamber 130 for containing ink.

For the end portion of the wall on the bottom side of the container that partitions the negative pressure generating-member containing chamber 130 and the ink-containing chamber 131, a communication passage is provided to enable both chambers to be communicated. On the bottom portion of the negative pressure-generating member containing chamber 130, the ink supply port 102 is provided, and on the ceiling portion, the atmosphere communication port 104 is provided to enable the inside of the chamber to be communicated with the air outside. Inside the negative pressure-generating member containing chamber 130 and ink supply port 102, there is arranged a pressure-welded member 133.

Also, in accordance with the present embodiment, the ink tank 100, which is a flat container, is structured to provide the ink supply port 102 on the surface other than the one having the largest area. As a result, when plural ink tanks 100 are mounted on an ink jet recording apparatus (not shown), there is an advantage that no extra space is needed for arranging them in parallel.

Next, with reference to FIG. 2B, the description will be made of the ink supply system of the ink tank 100.

When the ink tank 100 is mounted on an ink jet recording apparatus (not shown), the ink induction tube 200, which is arranged on the ink jet recording apparatus side, is inserted into the ink supply port 102 to compress the pressure-welded member 133. Here, as shown in FIG. 2B, a filter 201 may be fixed to the unsealing portion of the ink induction tube 200 in some cases. Then, with the operation of the ink jet recording apparatus, ink is discharged from an ink jet recording head (not shown), and suction power acts on ink in the ink container 101. By means of this suction power, ink enters the negative pressure-generating member containing chamber 130 from the ink-containing chamber 131, and then, drawn into the ink induction tube 200 through the negative generating member 132, thus being supplied to the ink jet recording head. In this way, the inner pressure of the ink-containing chamber 131 is reduced to make a pressure difference between the ink-containing chamber 131 and the negative pressure-generating member containing chamber 130. When the ink supply continues with the continuous recording operation of the ink jet recording head, the pressure difference is increased, but since the negative pressure-generating member containing chamber 130 is opened by the atmosphere communication portion 104, the air passes the negative pressure-generating member 132, and enters the ink-containing chamber 131. At this moment, the pressure difference between the ink-containing chamber 131 and the negative pressure generating-member containing chamber 130 is eliminated. During the recording operation, the operation of the kind is repeated to make it possible to supply ink smoothly.

Figure 3:
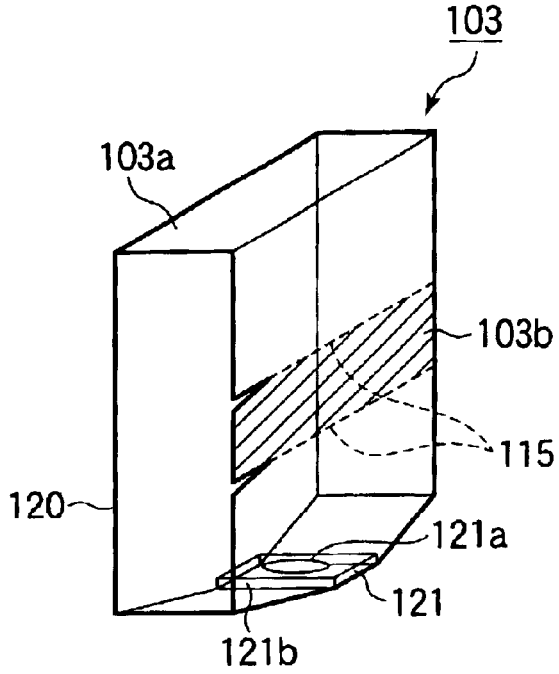
FIG. 3 is a perspective view that shows the covering member that covers the ink container represented in FIGS. 1A and 1B.

FIG. 3 is a perspective view of the covering member 103 that covers the ink container 101 as shown in FIGS. 1A and 1B. In FIG. 3, the portion indicated by slanted lines is a second part 103*b*, and the portions other than that represent a first part 103*a*. As shown in FIG. 3, the contour of the covering member 103 is circular (for the present example, it is cylindrical), and as described earlier, the covering member 103 is formed roughly by the first part 103*a* and the second part 103*b*. The cap 121 of the covering member 103 is arranged for the first part 103*a* so that as shown in FIGS. 1A and 1B, when the ink container 101 is covered by the covering member 103, the cap 121 abuts against the ink supply port 102. In the first part 103*a*, only the cap 121 is formed by separate material. The cap 121 compresses the ink supply port 102 to keep the ink container 101 airtight. Therefore, it is preferable to use elastomer for the material of the cap 121, because it is easily deformable.

For the covering member 103, the same material used for the second part 103*b* forms the wrapping member 120 for the first part 103*a*. Here, in consideration of covering the entire body of the ink container 101 compactly, while giving the cap 121 a compression force, which is exerted on the ink supply port 102, the material thereof should preferably be the shrink film that deforms to follow the shape of the outer edge of the ink container 101 to cover the ink container 101 as shown in FIGS. 1A and 1B when shrank by heat treatment. The first part 103*a* and the second part 103*b* integrally form the circular covering member 103. Then, perforations 115 are provided for the boundary between the first part 103*a* and the second part 103*b* as means for easy tearing whereby to make it possible to detach the covering member 103 easily by pulling up the second part 103*b*.

Now, the first part 103*a* of the covering member 103 will be described further in detail. The first part 103*a* is formed in such a manner that the cap 121 is fixed to the wrapping member 120, and the wrapping member 120 is formed substantially in the U-letter form if observed as a single body. In accordance with the present embodiment, two different materials form the cap 121, that is, the portion, which abuts against the ink supply port 102 and seals it, is formed by elastomer, and the circumferential portion that surrounds the elastomer portion is formed by polypropylene. Then, the cap 121 is arranged on the bottom face of the U-letter form of the wrapping member 120. The fixing method thereof is such as to fix the polypropylene portion 121*b* of the cap 121 on the circumference of the elastomer portion 121*a* to the wrapping member 120 by use of an adhesive agent or by thermal bonding. For the present embodiment, the wrapping member 120 and the cap 121 are fixed by use of an adhesive agent or by thermal bonding. However, in so far as the cap 121 does not drop off from the wrapping member 120 after the second part 103*b* is detached, there is no problem at all even if a mode is adopted so that no bonding means is provided for the wrapping member 120 to hold the cap 121.

Next, the description will be made of a method for covering the ink container 101 and the ink supply port 102 by use of the covering member 103.

At first, the wrapping member 120 of the covering member 103 is configured to be circular having the circumference larger than the length of the outer circumference of the portions of the ink container 101 to be covered. Then, the ink container 101 is inserted into the circular form of the wrapping member 120. After that, the ink container 101 and the covering member 103 are arranged so that the cap 121 and the ink supply port 102 abut upon each other. Using a holding device (not shown) the ink supply port 102 is pressed to the cap 121. Here, a holding device of any structure is usable unless damages are given thereby to the elastomer portion 121*a* of the cap 121.

Then, while the compression to the cap 121, which is exerted by use of the aforesaid holding device, is being maintained, heat treatment is given to the covering member 103 formed by shrink film, thus enabling the covering member 103 thermally shrank. At this juncture, heat treatment is given continuously until the shrink film that forms the covering member 103 is shrank to be closely in contact with the contour of the ink container 101, and then, the covering member 103 is given tensile strength good enough to seal the ink supply port 102 by the cap 121. After that, the ink container 101 is opened from the holding device. Thus, the covering member 103 completes covering the ink container 101. FIGS. 1A and 1B illustrate the state in which the ink container is completely covered.

Figure 4:
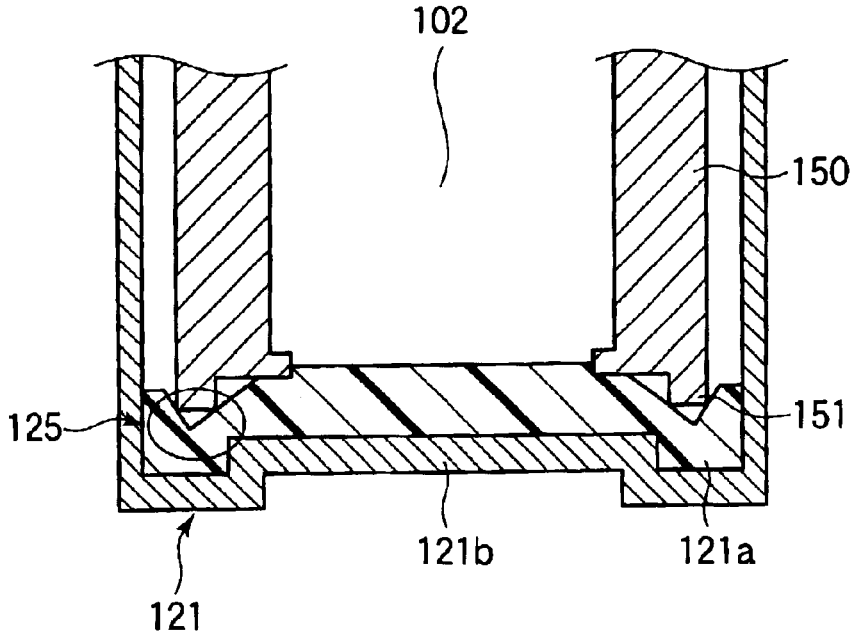
FIG. 4 is a cross-sectional view that shows the connecting relations between the ink supply port and the cap represented in FIGS. 1A and 1B.

Further, in conjunction with FIG. 4, the description will be made of the sealing condition of the ink supply port 102 and the cap 121 after the covering member 103 is thermally shrank. FIG. 4 is a cross-sectional view that shows the sealing condition of the ink supply port 102 and the cap 121, which seals the ink supply port. In FIG. 4, a cylindrical collar rib 150 is provided for the circumference of the unsealing portion of the ink supply port 102. The inner diameter of the collar rib 150 is almost the same as the diameter of the ink supply port 102. Further, an extrusion 151 is formed on the end face of the collar rib 150, which is cylindrically protruded. Also, for the elastomer portion 121*a* of the cap 121 against which the collar rib 150 abuts, the V-letter groove 125 is formed to receive the extrusion 151 of the collar rib 150.

As shown in FIG. 4, when the extrusion 151 and the V-letter groove 125 are in contact under pressure, the extrusion 151 enters the V-letter groove 125 by pushing the elastomer portion 121*a* so as to make it widely unseal. Then, the surface of the V-letter groove 125, which is in contact with the extrusion 151, is deformed to follow the shape of the extrusion 151, and the contact faces of the extrusion 151 and the V-letter groove 125 are closely in contact. In this way, the extrusion 151 and the inclined faces of the V-letter groove 125 are closely in contact with each other to produce effect on sealing the ink supply port 102 airtightly.

Figure 5A:
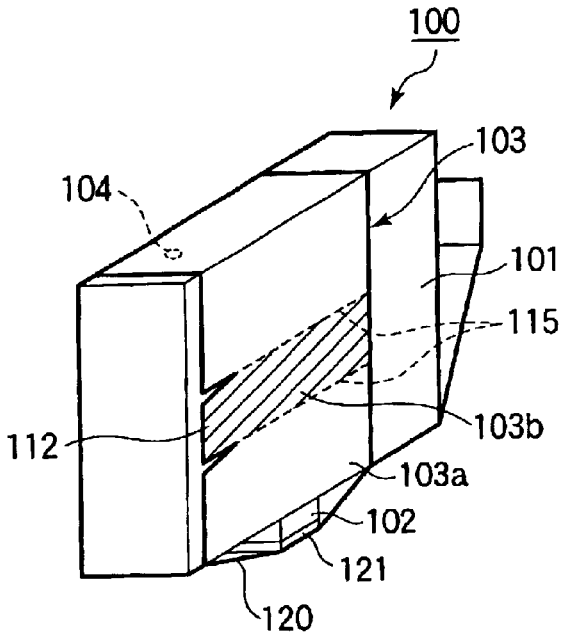
FIGS. 5A, 5B, 5C, and 5D are views that illustrate the unsealing method for the ink tank represented in FIGS. 1A and 1B.
Figure 5B:
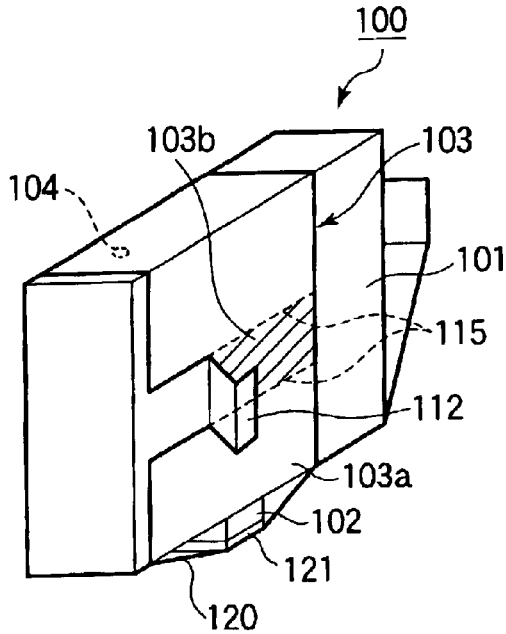
Figure 5C:
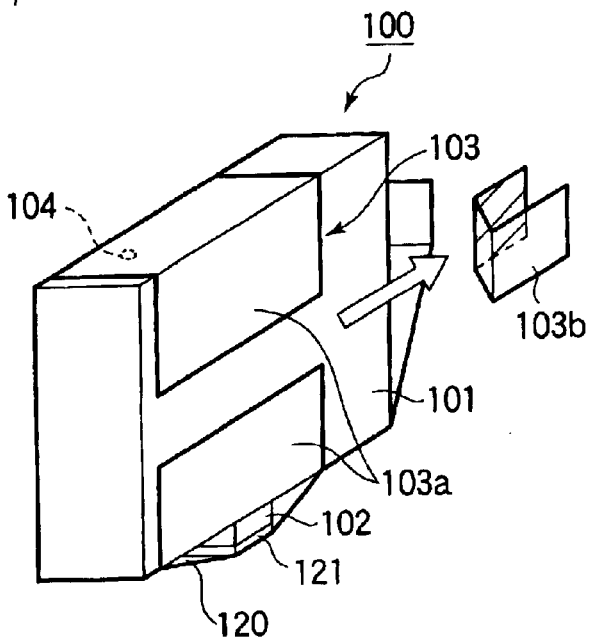

Next, in conjunction with FIGS. 5A to 5D, the description will be made of a method for unsealing an ink tank, which is the object of the present invention. FIG. 5A shows the condition before the unsealing operation; FIG. 5B shows the condition during the unsealing operation; FIG. 5C is a perspective view that shows an ink tank after unsealing; and FIG. 5D is a front view that shows the behavior of the first part 103*a* after unsealing.

Figure 6:
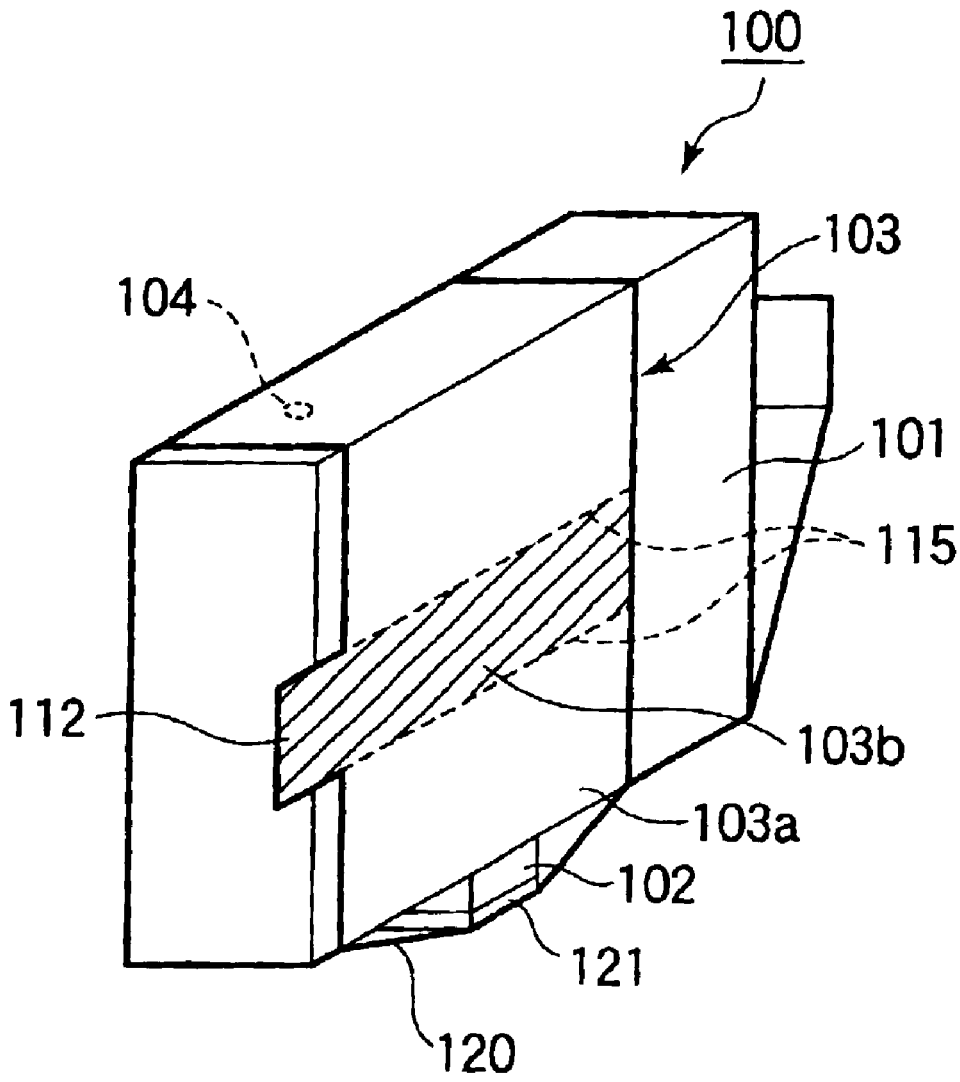
FIG. 6 is a view that shows the variational example of the second part represented in FIGS. 1A and 1B.

At first, the user holds the holding portion 112 of the second part 103*b* in order to detach the second part 103*b* of the covering member 103 that covers the circumferential faces of the ink container 101. In accordance with the present embodiment, the holding portion 112 of the second part 103*b* is the one formed by providing the perforations 115 therefor as shown in FIG. 5A. However, such portion may be the one, which is formed to protrude in a width larger than that of the covering member 103 (see FIG. 6). Also, it is still better to provide an indication for the holding portion 112 so that the user can recognize it distinctly as the holding portion 112. The user holds such holding portion 112 to remove the second portion 103*b* (FIG. 5B) along the perforations 115 provided for the boundary between both edges of the first part 103*a* and the second part 103*b*. The perforations 115 are arranged to make it easier to detach the covering member 103, and suggest the direction in which the second part 103*b* is removed. Therefore, the user finds it easier to remove the second part 103*b* by use of the perforations 115 in the right direction in which it should be cut without any mistakes. The direction in which the perforations 115 are provided is perpendicular to the covering direction of the covering member 103. With this arrangement, it is made possible to prevent the stress, which is exerted in removing the second part 103*b*, from being dispersed in the covering direction of the covering member 103. The stress, which is exerted at the time of removal, is determined by the size of the perforations 115. For example, if the pitches of perforations 115 are wide and make the stress larger for detaching the covering member 103, components of force are generated in the covering direction unless the second part 103*b* is moved in the direction perpendicular to the covering direction of the covering member 103. In-the worst case, the perforations 115 are not sheared, and the position of the covering member 103 may be deviated in the covering direction eventually. Should this event take place, the cap 121 is displaced to allow ink to leak or there is a fear that the ink supply port 102 is damaged. Any damage given to the ink supply port 102 of an ink tank may impede obtaining good results when the ink tank is mounted on an ink jet printer for recording. Therefore, in accordance with the present embodiment, the perforations 115 are arranged in the direction perpendicular to the covering direction of the covering member 103.

When the user removes the second part 103*b*, it is only the first part 103*a* that covers the ink container 101 as shown in FIG. 5C. In this state, the tensile force to hold the cap 121, which is exerted by the thermal shrinkage of the shrink film that serves as the covering member 103, is zero to make it impossible to hold the cap 121 any longer, thus unsealing the ink supply port 102.

Figure 5D:
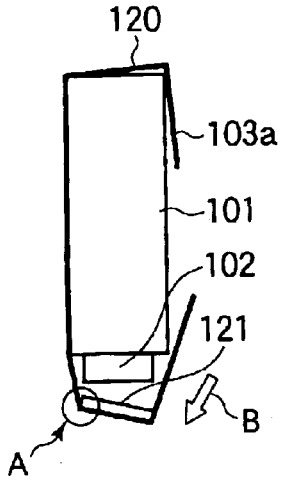

Then, in accordance with the present embodiment, the first part 103 remains to be hooked by the ceiling portion of the ink container 101 as shown in FIG. 5D. Now that the ink supply port 102 is provided for the bottom portion of the ink container 101, the cap 121 that has sealed the ink supply port 102 turns by the weight of the cap 121 own after unsealing the ink supply port 102 in the direction indicated by an arrow B in FIG. 5D centering around the corner portion of the wrapping member 120 (the rotation center A in FIG. 5D) that abuts against the corner portion of the ink supply port 102. Thus, the ink supply port 102 is unsealed. In accordance with the present embodiment, the detachment of the covering member 103, which is the user's unsealing operation, (that is, removal of the second part 103*b*) makes the unsealing impetus constant with respect to the ink supply port 102 irrespective of the detachment impetus, that is, irrespective of the individual difference of the user's behavior when performing the unsealing operation.

In accordance with the present embodiment, the unsealing impetus that may be exerted when removing the second part 103*b*, and the position at which the cap 121 stops are adjusted by the weight of the cap 121 own, which works in the unsealing direction (the direction indicated by the arrow B in FIG. 5D), and also, by the strength of material used for the wrapping member 120, which works in the direction in which the closure of the cap 121 is maintained, that is, the direction opposite to the unsealing direction, because the ink supply port 102 is provided for the bottom portion of the ink container 101. In other words, the vigorous unsealing can be suppressed by controlling the weight of the cap 121 own and the strength of the material used for the wrapping member 120. As a result, it is made possible to prevent the phenomenon that ink between the ink supply port 102 and the cap 121 is pulled to splash without adhering to either side of them when being unsealed. The position at which the cap 121 stops should desirably be the one that enables the cap 121 to face the ink supply port 102 substantially, and also, to be close to the ink supply port 102. This is because ink flies into the cap 102, which stops at the aforesaid position, even if ink should splash from the ink supply port 102, thus being trapped therein without allowing it splash externally.

The material used for the wrapping member 120 of the present embodiment is polyester shrink film, and it is known that the material strength of this shrink film depends on the thickness thereof. For the present embodiment, it is known by experiments that unsealing is possible without ink splashes by setting the thickness of the wrapping member 120 at 0.04 mm and the weight of the cap 121 at 2 g. However, these values are not necessarily limited thereto. It should be good enough if only the values are set so as not to allow ink to splash when being unsealed. Also, in accordance with the present embodiment, the arrangement position of the ink supply port 102 is at the bottom portion of the ink container 101. Therefore, the sealing impetus has been described as above. However, for example, in a case of an ink container having the ink supply port arranged on the ceiling portion, which is opposite to the bottom portion, it is possible to select the material more freely to a certain extent, because the selection thereof is not dependent on the aforesaid unsealing impetus.

Figure 13B:
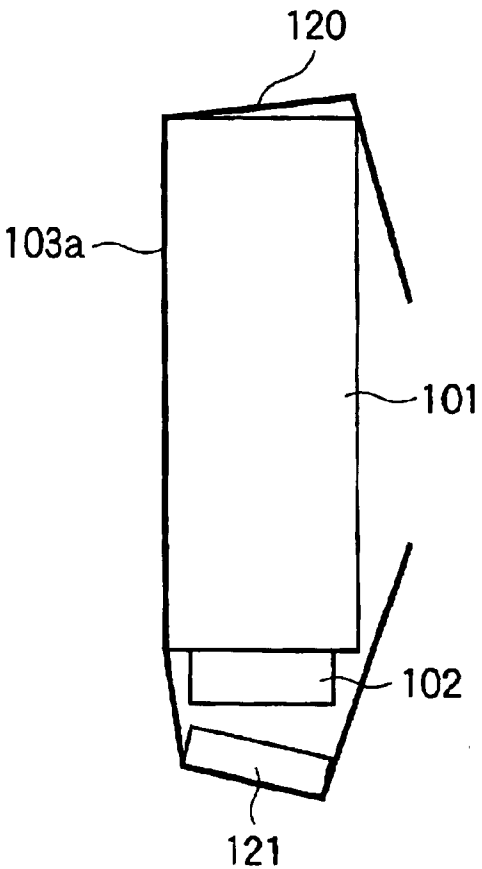
FIGS. 13A and 13B are views that illustrate another mode of preventing the dropping-off of the covering member in the first part shown in FIGS. 1A and 1B.
Figure 13A:
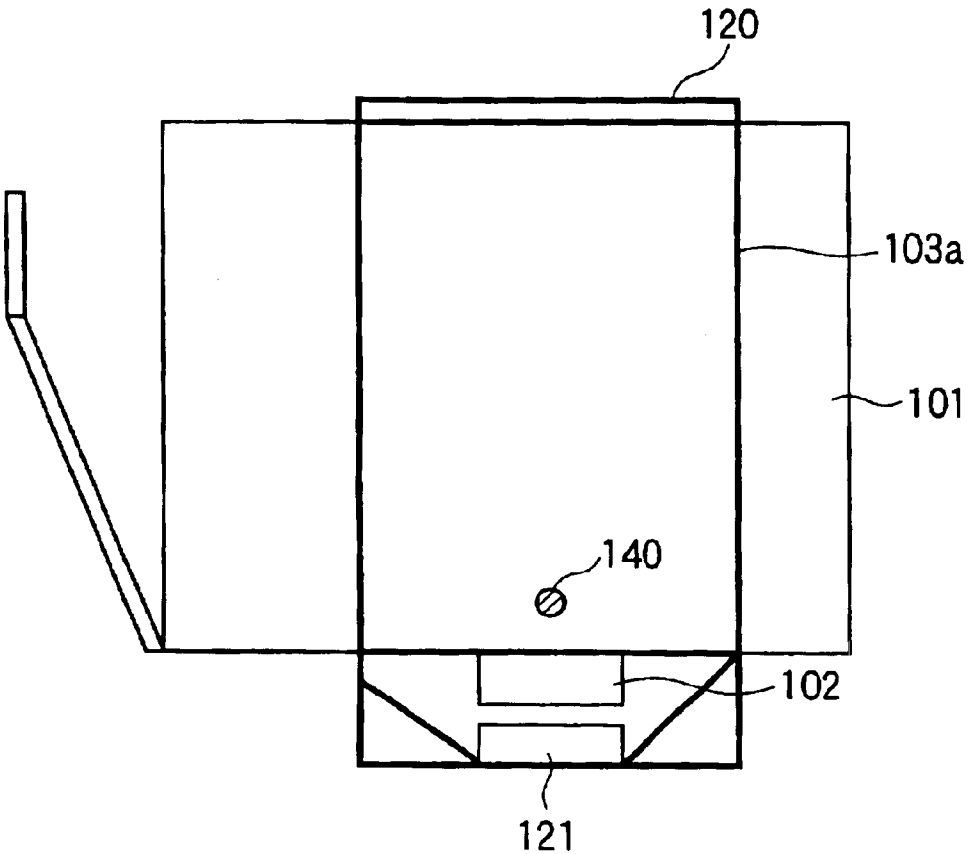

Now, after having removed the second part 103*b*, there may be a fear that the first part 103*a* falls off entirely by its own weight. In accordance with the present embodiment, however, a countermeasure is taken in such a manner that the second part 103*b* is positioned on the side face of the ink container 101. Even after the second part 103*b* has been removed, the shape of the portion of the wrapping member 120, which corresponds to the ceiling portion of the ink container 101, is maintained along the contour of the ink container 101, because the first part 103*a* of the wrapping member 120 is formed by shrink film. With a configuration of the kind, the wrapping member is hooked as shown in FIG. 5D even after the second part 103*b* has been removed, and further, the material strength of the shrink film is high so as not to allow the first part 103*a* to fall off easily. For the present embodiment, the first part 103*a* is formed substantially in the U-letter form to prevent the first part from falling off after the second part 103*b* has been detached. In this respect, as means for preventing the fall-off of the first part 103*a*, it may be possible to maintain the first part 103*a* by bonding (by the bonding area 140 of the first part) as shown in FIGS. 13A and 13B. In this mode, the fall-off of the first part 103*a* can be prevented more reliably. The bonding power of the bonding area 140 of the first part should be good enough if only it is set to provide the minimum bonding power for serving the purpose of preventing the first part 103*a* from falling off. There is no need for the provision of any stronger bonding power to provide an airtight sealing, for example. With the bonding thus made, it is unnecessary for the user to exercise any vigorous pulling when the first part 103*a* is removed as described later. Then, even for the structure of the kind, it is still possible to suppress any vigorous unsealing by controlling the material strength of the wrapping member 120. For the present embodiment, the spot thermal welding is adopted for bonding means, but the method of welding is not necessarily limited thereto. Any bonding means is adoptable without problem if only such means is capable of preventing the fall-off of the first part. Here, also, the hooking by means of the material rigidity of the wrapping member 120 may be used together without any problem.

As described above, the first part 103*a* of the ink container 101 is held with a weak power even after the second part 103*b* has been removed. The user holds the first part 103*a* and pulls it in the direction perpendicular to the covering direction. Then, the first part 103*a* is easily removed. At this juncture, the first part 103*a* is not bonded to the ink container 101 with any strong force, nor there is any regulation at all. The user finds it unnecessary to pull it vigorously. Therefore, ink adhering to the sealing portion of the cap 121 does not splash.

In accordance with the present embodiment, it is necessary for the user only to operate removing the second part 103*b* to detach the covering member 103, and then, to operate removing the first part 103*a* for unsealing the ink supply port 102. Here, only pulling action is required for the execution of both operations. Further, there is no regulation for the impetus that may take place at the time of unsealing. Also, perforations are provided. As a result, there is no need of exercising any large power, hence making it possible to anyone to perform unsealing with ease.

In FIG. 5A that shows the mode of the present embodiment, the atmosphere communication port 104 is present under the covering member 103, and it looks as if the atmosphere, communication port 104 were sealed. Actually, however, the covering member 103 is not provided individually with any means for closing the atmosphere communication port 104 tightly, and in this state, the atmosphere communication port 104 is opened. In other words, the ink container 101 is not in the state of being closed up tightly at any time even before being unsealed. Consequently, the position of the atmosphere communication port 104 is not necessary limited to the ceiling face of the ink container 101 covered by the covering member 103. If only this port is communicated with the negative pressure generating member containing chamber 130, it can be positioned anywhere without problem.

(Second Embodiment)

Figure 7:
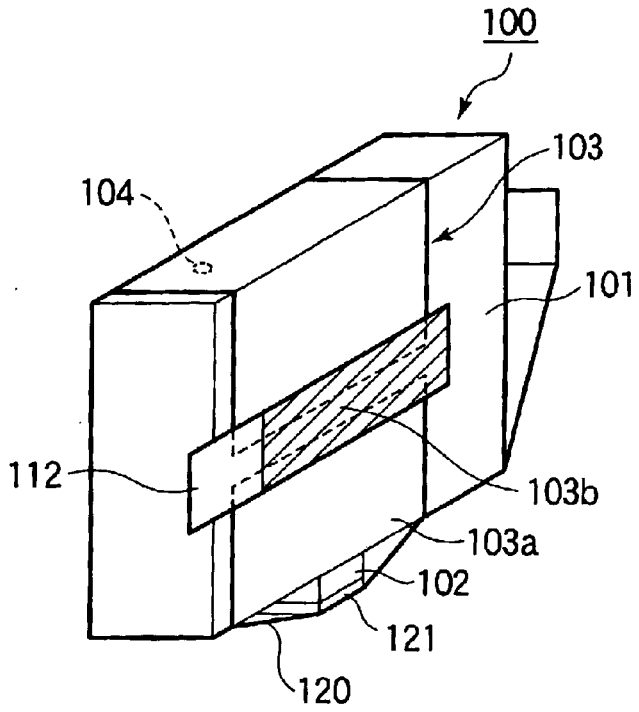
FIG. 7 is a perspective view that shows the packaging structure of an ink tank in accordance with a second embodiment of the present invention.

Next, with reference to FIG. 7, the description will be made of a second embodiment of the ink tank in accordance with the present invention. Here, what differs from the first embodiment will be described mainly. FIG. 7 is a perspective view that shows the packaging structure of an ink tank in accordance with the second embodiment of the present invention.

For the ink tank 100 in a mode as shown in FIG. 7, the covering member 103 is structured to be circular by bonding the first part 103*a* and the second part 103*b* thereof. The wrapping member 120 that constitutes the first part 103*a* is formed by shrink film with the exception of the cap 121. Then, the film, which is provided with adhesive agent, forms the second part 103*b*. Along the contour of the flat rectangular ink container 101, the wrapping member 120 is provided in the U-letter form. Both ends of the wrapping member 120 face each other on the side face of the ink container 101 (on the surface having the largest area adjacent to the surface where the ink supply port 102 is arranged in accordance with the present embodiment). Then, the releasing ends of the first part 103*a* (wrapping member 120) are connected with the second part 103*b* by use of adhesive agent. Thus, the covering member 103 is maintained in a cylindrical form on the outer circumference of the ink container 101. With the structure thus arranged, when the second part 103*b*, which is adhesively bonded to the first part 103*a*, is pulled and peeled off, the covering member 103 is easily separated to unseal the ink supply port 102.

For the present embodiment, too, it is possible to apply to the fall-off prevention of the first part 103*a* either the type in which it is maintained by the aforesaid rigidity of material or the type in which it is maintained by bonding, and also, equally applicable the type in which both of them are adopted.

As in the first embodiment, the present embodiment adopts the structure, which does not allow the direct unsealing of the ink supply port. Therefore, it is possible to carry out unsealing at a constant impetus irrespective of the difference in unsealing impetus brought about by each individual user. Also, the aforesaid unsealing impetus can be controlled by the weight of the cap 121 own and the material strength of the wrapping member 120 used for the first part, hence making it easier to provide the prevention of ink splashing.

(Third Embodiment)

Figure 8:
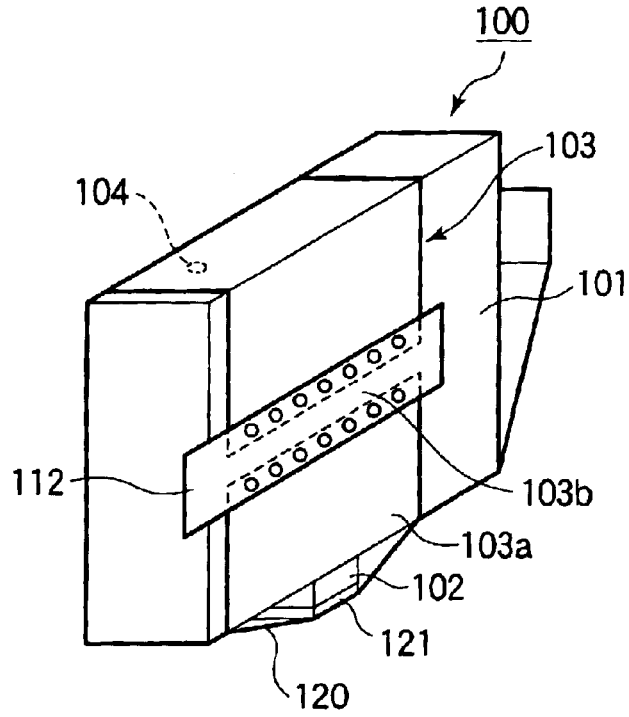
FIG. 8 is a perspective view that shows the packaging structure of an ink tank in accordance with a third embodiment of the present invention.
Figure 9A:
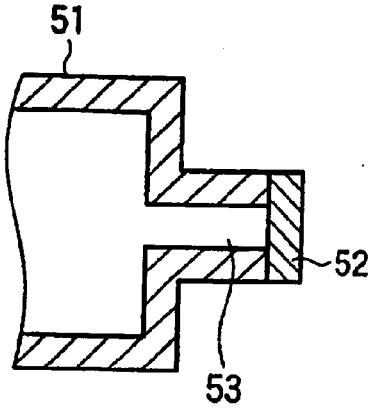
FIG.9A (PRIOR ART)
FIGS. 9A, 9B, and 9C are views that illustrate the causes of ink splashing when the conventional ink tank is unsealed.
Figure 9B:
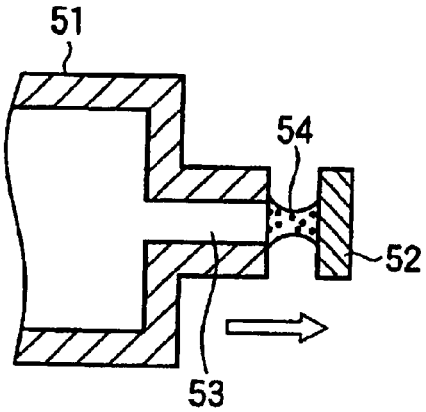
FIG.9B (PRIOR ART)
Figure 9C:
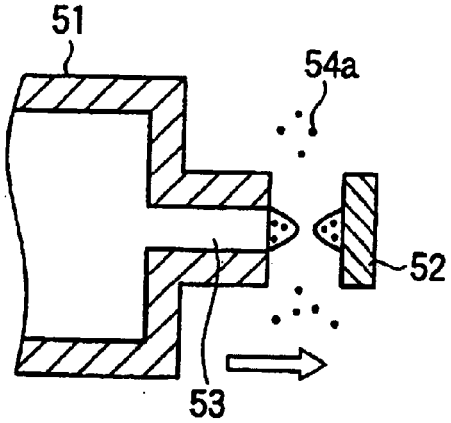
FIG.9C (PRIOR ART)
Figure 10A:
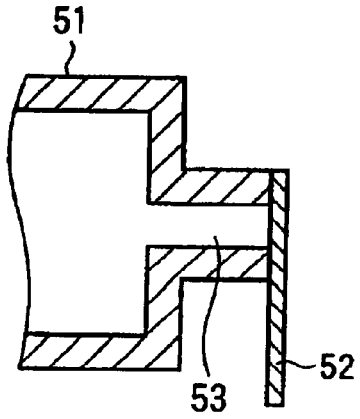
FIG.10A (PRIOR ART)
FIGS. 10A, 10B, and 10C are views that illustrate the causes of ink splashing when the conventional ink tank is unsealed.
Figure 10B:
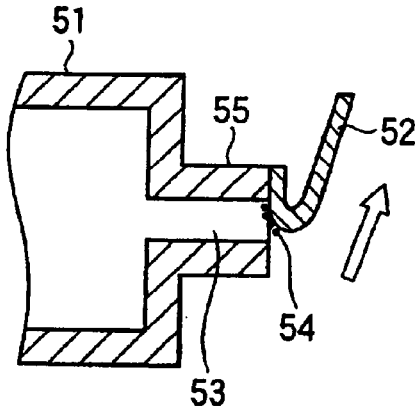
FIG.10B (PRIOR ART)
Figure 10C:
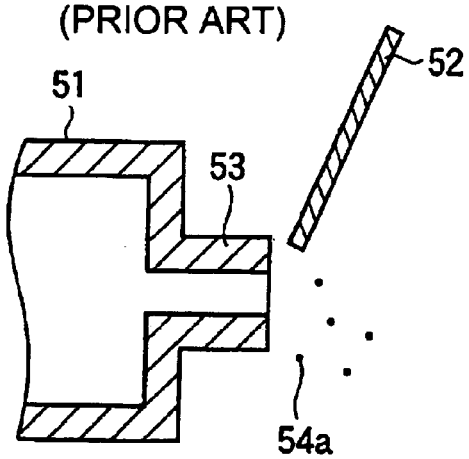
FIG.10C (PRIOR ART)
Figure 11A:
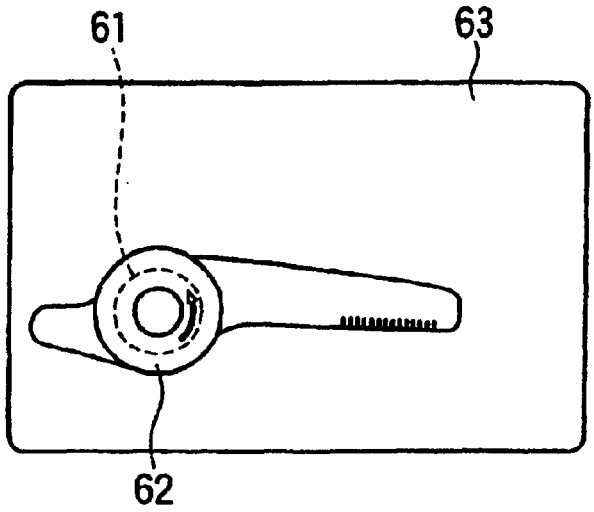
FIG.11A (PRIOR ART)
FIGS. 11A and 11B are views that illustrate the example in which a cap is used as means for unsealing the conventional ink tank.
Figure 11B:
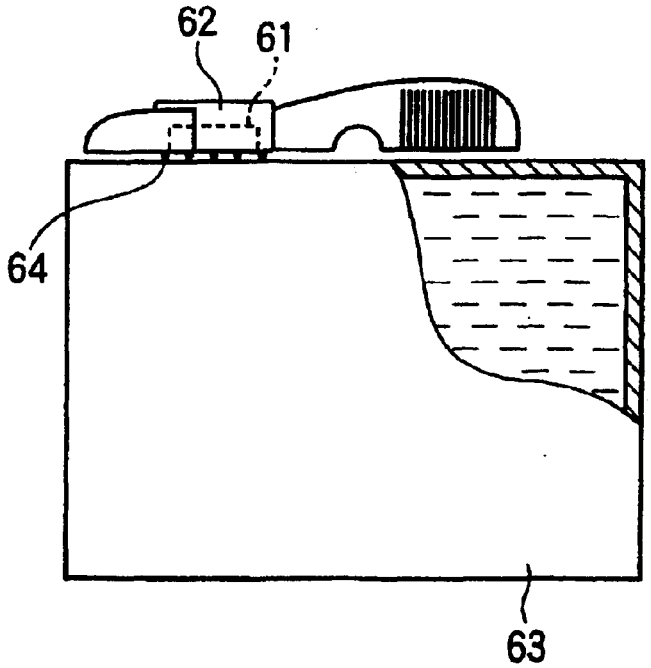
FIG.11B (PRIOR ART)

Next, with reference to FIG. 8, the description will be made of a third embodiment of the ink tank in accordance with the present invention. Here, what differs from the first and second embodiments will be described mainly. FIG. 8 is a perspective view that shows the packaging structure of the ink tank in accordance with the third embodiment.

For the ink tank 100 in a mode as shown in FIG. 8, the covering member 103 is structured to be circular by bonding the first part 103*a* and the second part 103*b* thereof. The wrapping member 120 that constitutes the first part 103*a* is formed by shrink film with the exception of the cap 121. Then, the film, which is provided with adhesive agent, forms the second part 103*b*.

The present embodiment is different from the second embodiment in the method of bonding adopted for the first part 103*a* and the second part 103*b*. In other words, the first part 103*a* (wrapping member 120) covers the ink container 101 along the contour of the flat rectangular ink container 101 in the U-letter form so as to enable both ends thereof to face each other on the side face of the ink container 101 (on the surface having the largest area adjacent to the surface where the ink supply port 102 is arranged in accordance with the present embodiment). Then, the releasing ends of the first part 103*a* that covers the ink container are connected by the second part 103*b* by use of spot welding. Thus, the covering member 103 is maintained in a cylindrical form on the outer circumference of the ink container 101. With the structure thus arranged, when the second part 103*b*, which is spot-welded to the first part 103*a*, is pulled and peeled off, the covering member 103 is easily separated to unseal the ink supply port 102.

For the present embodiment, too, it is possible to apply to the fall-off prevention of the first part 103*a* either the type in which it is maintained by the aforesaid rigidity of material or the type in which it is maintained by bonding, and also, equally applicable the type in which both of them are adopted.

As in the first embodiment, the present embodiment adopts the structure, which does not allow the direct unsealing of the ink supply port. Therefore, it is possible to carry out unsealing at a constant impetus irrespective of the difference in unsealing impetus brought about by each individual user. Also, the aforesaid unsealing impetus can be controlled by the weight of the cap 121 own and the material strength of the wrapping member 120 used for the first part, hence making it easier to provide the prevention of ink splashing.

In accordance with the aforesaid first and second embodiments, shrink film is used for the first part 103*a* of the covering member 103, and film material is used for the second part 103*b*, and the structure is arranged to bond them with each other. However, the present invention is not necessarily limited to the use of these materials if only a structure is arranged so that the covering member 103 enables the cap 121 to exert a compressive force to the ink supply port 102. For example, an elastic member (such as rubber, elastomer), which is configured along the contour of the ink container 101, is used for the first part 103*a*, and the first part 103*a* is arranged for the outer circumference of the ink container 101. Then, in a state where a tensile force is provided for the first part 103*a*, both ends of the first part 103*a* is provisionally fixed to the second part 103*b*, making it possible to keep the ink supply port 102 airtight by the cap 121.

(Fourth Embodiment)

Figure 12:
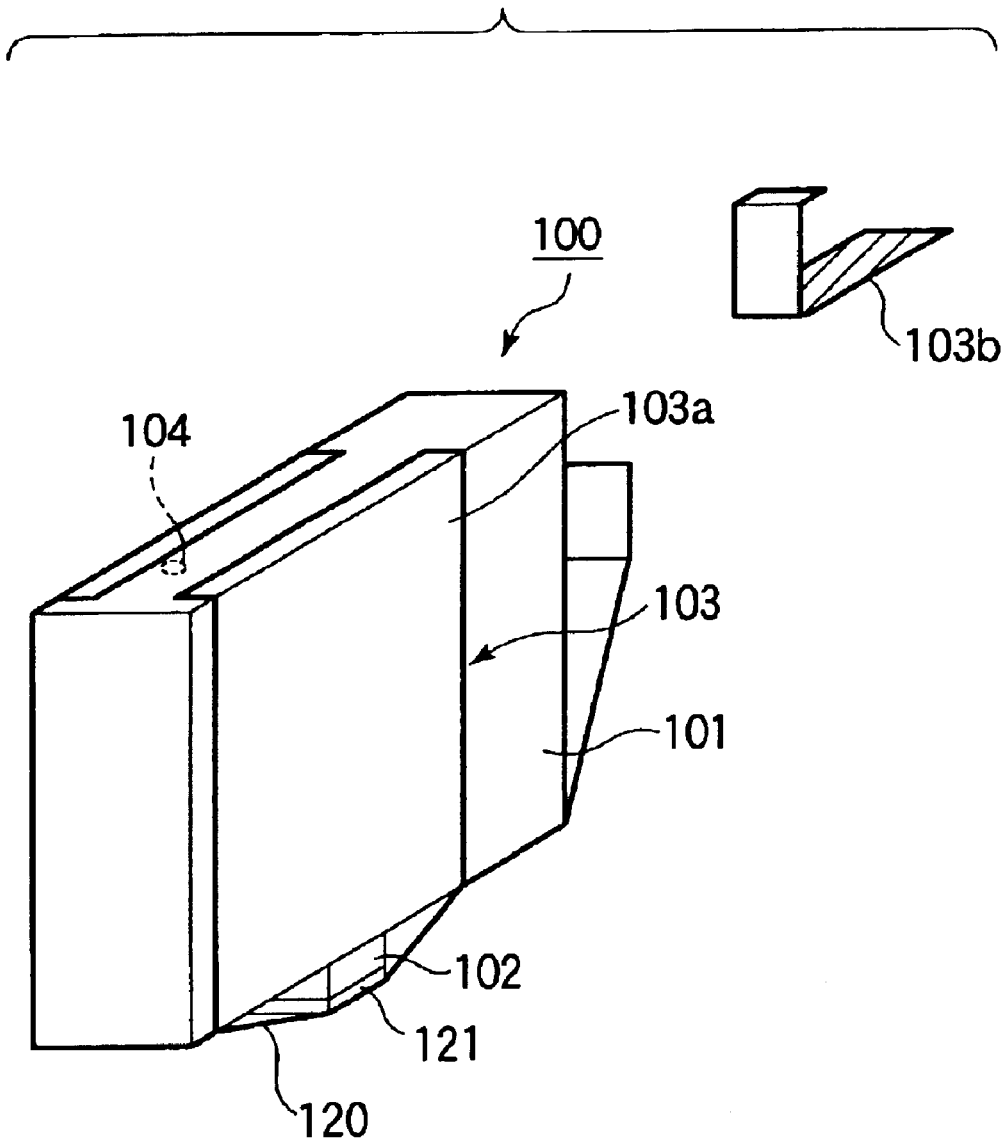
FIG. 12 is a perspective view that illustrates the shape of the first part of the covering member shown in FIGS. 1A and 1B.

Next, with reference to FIG. 12, the description will be made of an ink tank in accordance with a fourth embodiment. Here, what differs from the first embodiment will be described mainly. FIG. 12 is a perspective view that shows the packaging structure of an ink tank in accordance with the forth embodiment of the present invention.

The present embodiment is different from each of the embodiments previously described in the shape of the first part 103*a*. The first part of the present embodiment is in such shape that both ends thereof cover the upper face of the ink tank having the atmosphere communication port 104 provided therefor, and the second member 103*b* is provided for the upper face portion of the ink tank so as to seal the atmosphere communication port by thermal bonding. Although the first part 103*a* is in such form, both ends thereof are configured to hook the upper face of the ink tank. Therefore, even after the second part 103*b* is removed, the first part 103*a* is not allowed to drop off. Also, it is possible to prevent falling off by the aforesaid type of maintaining the first part 103*a* by means of bonding. It is of course possible to adopt both types together.

Here, when the ink tank is structured to provide the ink containing chamber and the negative pressure generating member containing chamber as shown in FIGS. 2A and 2B, it is desirable to unseal the ink supply port after the atmosphere communication port has been unsealed for the prevention of ink leakage. In accordance with the present embodiment, the atmosphere communication port is unsealed reliably prior to the ink supply port by removing the second part. Therefore, this embodiment is desirable in that the ink leakage is still smaller than that of each of the previous embodiments.

Here, for the present embodiment, and equally for the other embodiments, it becomes possible to enhance the air-tightness of the atmosphere communication port if an elastic member, such as rubber, is used for the contacting portion of the first or second part with the atmosphere communication port as another means for making the sealing thereof more reliable.

Figure 14:
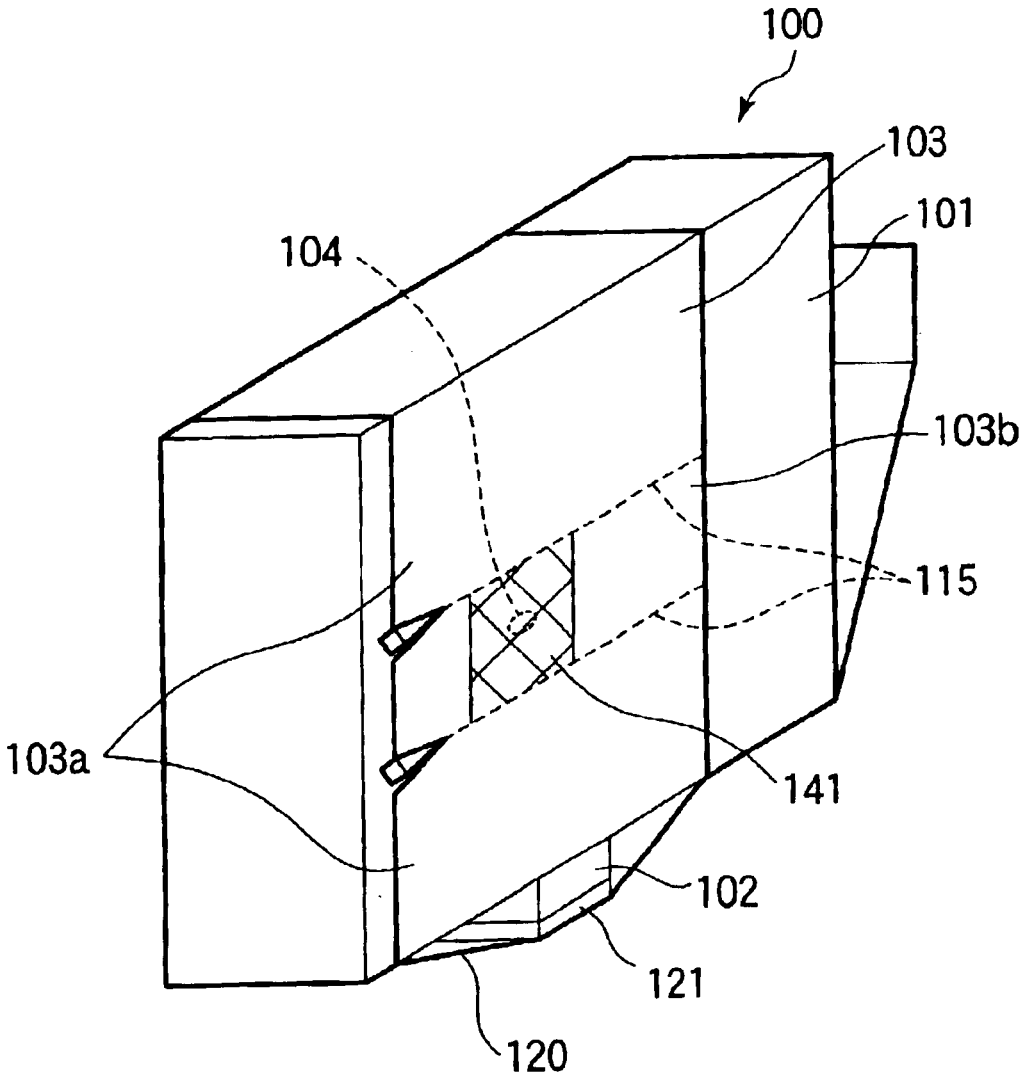
FIG. 14 is a view that shows the variational example of the second part represented in FIGS. 1A and 1B.

In FIG. 12, the sealing of the atmosphere communication port is carried out by thermal bonding of the second part. However, bonding means is not necessarily limited thereto. For example, as shown in FIG. 14, it may be possible to bond only the contacting portion (bonding area 141) of the second part with the atmosphere communication port by use of adhesive agent or to adopt any other bonding means if only the atmosphere communication port 104 can be kept airtight.

As described above, in accordance with the present invention, the packaging structure is formed to cover by a covering member the liquid supply port of a liquid container that contains liquid therein, and a circular member formed by first and second parts is used to cover the outer circumference of the liquid container. Then, sealing means is provide for the first part to seal the liquid supply port, and with the second part, which is made separable from the first part, unsealing is made possible indirectly by operating the detachment of the second part, but not to remove means for sealing the liquid supply port directly for unsealing. Therefore, unsealing is possible at a constant impetus irrespective of the impetus exerted by unsealing carried out by each individual user. Also, the unsealing impetus can be controlled by the weight of a constituent of the first part own and the strength of material used therefor, hence making it possible to set up the prevention of liquid splash at the time of unsealing.

Also, the material used and the shape formed for the first part are such as to be maintained along the outer circumference of the liquid container, the first part remains around the liquid container even after the second part is separated from the first part. Therefore, the separation of the second part does not ensue in the fall-off of the first part. Further, the same effect as described above is still obtainable when the first part and the liquid container are bonded but in a strength just good enough to prevent the fall-off of the first part. Furthermore, since the first part is not bonded to the liquid container in such a strength as to maintain the air tightness of the first part, there is no need for the user to pull the first part vigorously when he removes it. Consequently, liquid adhering to the means for sealing the liquid supply port does not splash.

Also, the user's operation of unsealing the liquid supply port is only such as to detach the covering member by removing the second part, and to remove the first part. Further, there is no regulation with respect to the impetus at the time of unsealing. As a result, it is unnecessary to use any large force for the operation, and anyone can carry out the unsealing operation simply.

What is claimed is:

1. A packaging structure of a liquid container provided with a liquid containing portion for containing liquid and a liquid supply port for supplying said liquid, comprising:

a covering member for covering said liquid supply port, wherein said covering member is a circular member formed by a first part and a second part to cover the outer circumference of said liquid container, said first part being provided with sealing means for sealing said liquid supply port, said second part being made detachable from said first part, and said sealing means sealing said liquid supply port in non-bonded sealing contact to said liquid supply port in a condition that said liquid container is packaged by said covering member and the circular form of said covering member is broken by the detachment of said second part; and wherein said first part covers an edge of an upper surface of said liquid container even after detachment of said second part.

2. A packaging structure according to claim 1, wherein even when said second part is detached from said first part, means for sealing the liquid supply port of said first part remains near said liquid supply port.

3. A packaging structure according to claim 1, wherein said covering member is a film-like material.

4. A packaging structure according to claim 1, wherein said covering member is a thermally shrinkable film-like material.

5. A packaging structure according to claim 1, wherein said covering member is an elastic member.

6. A packaging structure according to claim 1, wherein said first part and said second part are formed integrally, and breaking means is provided at the boundary of said first part and said second part to break the boundary.

7. A packaging structure according to claim 6, wherein said breaking means is perforations.

8. A packaging structure according to claim 1, wherein said first part and said second part are formed separately, and said second part is made detachable from said first part.

9. A packaging structure according to claim 1, wherein said means for sealing the liquid supply port is a cap member.

10. A packaging structure according to claim 9, wherein said cap member has an elastic member.

11. A packaging structure according to claim 1, wherein said liquid container is provided with an atmosphere communication port to enable the inside of said container to be communicated with the air outside, and said covering member is provided with an elastic member to cover said atmosphere communication port.

12. A packaging structure according to claim 1, wherein said liquid container is provided with an atmosphere communication port to enable the inside of said container to be communicated with the air outside, and said atmosphere communication port is sealed by bonding with said second part.

13. A packaging structure according to claim 1, wherein said liquid container is detachably mountable on a recording apparatus for recording by enabling recording liquid to adhere to a recording medium.

14. A method for unsealing a liquid container provided with a liquid containing portion and a liquid supply port for supplying said liquid, wherein said liquid supply port is covered by a covering member;

said covering member is a circular member formed by a first part and a second part for covering the outer circumference of said liquid container;

said first part is provided with sealing means for sealing said liquid supply port to seal said liquid supply port;

said seals means sealing said liquid supply port in non-bonded sealing contact to said liquid supply port in a condition that said liquid container is packaged by said covering member, said second part is detachable from said first part; and said first part covers and edge of an upper surface of said liquid container even after detachment of said second part, said method comprising the steps of first, the circular form of said covering member is broken by the detachment of said second part from said first part, said first part remains hooked over said edge of the liquid container, and then said first part is separated from said liquid supply port so that said liquid supply port is unsealed.

15. A method for unsealing a liquid container according to claim 14, wherein the detachment direction of said second part is in the direction substantially perpendicular to the wrapping direction of said covering member.

16. A method for unsealing a liquid container according to claim 14, wherein after said liquid supply port is opened subsequent to the detachment of said second part from said first part, said first part is maintained along the outer circumference of said liquid container for the prevention of fall-off thereof from said liquid container, and subsequently, said first part is removed.

17. A method for unsealing a liquid container according to claim 14, wherein after said liquid supply port is opened subsequent to the detachment of said second part from said first part, said first part does not fall off from said liquid container by being bonded to said liquid container, and subsequently, said first part is removed.

18. A method for unsealing a liquid container according to claim 17, wherein after said liquid supply port is opened, the position of means for sealing said liquid supply port of said first part is a position substantially facing said liquid supply port and near said liquid supply port.

* * * * *